US009556737B2

(12) United States Patent
Janarthanan et al.

(10) Patent No.: US 9,556,737 B2
(45) Date of Patent: Jan. 31, 2017

(54) AIR SEPARATOR FOR GAS TURBINE ENGINE

(71) Applicants: Mahesh Janarthanan, Charlotte, NC (US); Diego L. Caso, Jr., Winter Garden, FL (US); Ryan J. Majkut, Charlotte, NC (US)

(72) Inventors: Mahesh Janarthanan, Charlotte, NC (US); Diego L. Caso, Jr., Winter Garden, FL (US); Ryan J. Majkut, Charlotte, NC (US)

(73) Assignee: SIEMENS ENERGY, INC., Orlando, FL (US)

( * ) Notice: Subject to any disclaimer, the term of this patent is extended or adjusted under 35 U.S.C. 154(b) by 579 days.

(21) Appl. No.: 14/082,493

(22) Filed: Nov. 18, 2013

(65) Prior Publication Data

US 2015/0139782 A1 May 21, 2015

(51) Int. Cl.

| | |
|---|---|
| ***F01D 5/08*** | (2006.01) |
| ***F01D 5/06*** | (2006.01) |
| ***F01D 11/00*** | (2006.01) |

(52) U.S. Cl.

CPC ..... *F01D 5/08* (2013.01); *F01D 5/066* (2013.01); *F01D 11/001* (2013.01)

(58) Field of Classification Search

CPC ..... F01D 5/08; F01D 11/001; F01D 11/003; F01D 5/066; F04D 29/08

See application file for complete search history.

(56) References Cited

U.S. PATENT DOCUMENTS

| | | | |
|---|---|---|---|
| 3,602,605 | A | 8/1971 | Lee et al. |
| 3,644,058 | A | 2/1972 | Barnabei et al. |
| 4,674,955 | A | 6/1987 | Howe et al. |
| 5,310,319 | A | 5/1994 | Grant et al. |
| 5,333,993 | A | 8/1994 | Stueber et al. |
| 5,670,879 | A | 9/1997 | Zombo et al. |
| 5,816,776 | A | 10/1998 | Chambon et al. |
| 5,951,250 | A | 9/1999 | Suenaga et al. |
| 6,151,881 | A | 11/2000 | Ai et al. |
| 7,341,429 | B2 | 3/2008 | Montgomery et al. |
| 7,815,415 | B2 | 10/2010 | Kanezawa et al. |
| 8,444,387 | B2 | 5/2013 | Morris et al. |

*Primary Examiner* — Gregory Anderson
*Assistant Examiner* — Maxime Adjagbe

(57) ABSTRACT

An air separator in a gas turbine engine includes a cylindrical member and a seal flange having a flange body extending radially outward at a rearward end of the cylindrical member. A head portion is located at a radially outer free end of the flange body and includes an axial flange located axially rearward of the flange body and defining a rearward seal face for engagement with a blade disc forward face, and a forward cantilevered head mass extending axially forward from the flange body. An axial dimension of the head mass, from a connection with the forward side of flange body to an axially forward face of the head mass, is greater than a maximum radial dimension of the head mass, from a radially inner side of the head mass to a radially outermost side of the head mass.

15 Claims, 4 Drawing Sheets

AIR SEPARATOR FOR GAS TURBINE ENGINE

FIELD OF THE INVENTION

This invention relates generally to gas turbine engines and, more particularly, to an air separator providing a seal in a gas turbine engine.

BACKGROUND OF THE INVENTION

Turbomachines, such as gas turbine engines, generally include a compressor section, a combustor section and a turbine section. A rotor is typically provided extending axially through the sections of the gas turbine engine and includes structure supporting rotating blades in the compressor and turbine sections. In particular, a portion of the rotor extending through the turbine section comprises a plurality of turbine discs joined together wherein each turbine disc is adapted to support a plurality of turbine blades. Similarly, a portion of the rotor extending through the compressor section comprises a plurality of compressor discs joined together wherein each compressor disc is adapted to support a plurality of compressor blades. The portions of the rotor in the turbine and compressor sections are connected by a torque tube.

In view of high pressure ratios and high engine firing temperatures, certain components, such as rotating blade structures supported on the turbine discs, must be cooled with cooling fluid, such as compressor discharge air, to prevent overheating of the components. In order to channel a portion of the compressor discharge air to the turbine discs and associated blades, an air separator may be mounted on the torque tube and engage on a forward face of a forward-most turbine disc.

SUMMARY OF THE INVENTION

In accordance with an aspect of the invention, a gas turbine engine is provided comprising a rotor structure including a blade disc structure and a torque tube coupled to the blade disc structure. A blade disc forward face is defined on an upstream side of the blade disc structure with respect to an axial flow of hot working gas through the engine, and the torque tube extends axially forward from the forward face. An air separator is provided and includes a cylindrical member disposed around the torque tube to form a clearance between an inner surface of the cylindrical member and an outer surface of the torque tube. A seal flange extends radially outward at a rearward end of the cylindrical member, and a forward end of the cylindrical member includes mounting structure attaching the cylindrical member to the torque tube. The seal flange includes a flange body having a forward side extending radially outward from the cylindrical member, and an opposing rearward side, the forward and rearward sides defining a flange thickness therebetween. A head portion is located at a radially outer free end of the flange body. The head portion includes an axial flange located axially rearward of the flange body and defining a rearward seal face for engagement with the blade disc forward face, and a forward cantilevered head mass extending axially forward from the flange body. An axial dimension of the head mass, from a connection with the forward side of flange body to an axially forward face of the head mass, is greater than a maximum radial dimension of the head mass, from a radially inner side of the head mass to a radially outermost side of the head mass.

The axial dimension of the head mass may be greater than an axial dimension of the axial flange from the rearward side of the flange body to the rearward seal face. The axial dimension of the head mass may be about 42% greater than the axial dimension of the axial flange.

The axial dimension of the head mass may be about five times greater than an axial thickness of the flange body between the forward side and the rearward side.

The flange body may be angled in the forward direction away from the blade disc forward face, defining an acute angle between the forward side of the flange body and an outer surface of the cylindrical member. An acute angle may be defined between the rearward side of the flange body and the outer surface of the cylindrical member, wherein the rearward end of the cylindrical member may be a planar radial surface intersecting the rearward side of the flange body at an inflexion point radially outward from the outer surface of the cylindrical member.

A strong back may span between the outer surface of the cylindrical member and the forward side of the flange body, and the strong back may span radially outward from the cylindrical member to an intersection point with the forward side of the flange body radially outward from the inflexion point. The intersection point may be located at least about 40% of a radial distance between the outer surface of the cylindrical member and the inner side of the head mass. The inflexion point may be located at least about 16% of a radial distance between the outer surface of the cylindrical member and the inner side of the head mass.

In accordance with another aspect of the invention, a gas turbine engine is provided comprising a rotor structure including a blade disc structure and a torque tube coupled to the blade disc structure. A blade disc forward face is defined on an upstream side of the blade disc structure with respect to an axial flow of hot working gas through the engine, and the torque tube extends axially forward from the forward face. An air separator is provided and includes a cylindrical member disposed around the torque tube to form a clearance between an inner surface of the cylindrical member and an outer surface of the torque tube. A seal flange extends radially outward at a rearward end of the cylindrical member and a forward end of the cylindrical member includes mounting structure attaching the cylindrical member to the torque tube. The seal flange includes a flange body having a forward side extending radially outward from the cylindrical member, and an opposing rearward side, the forward and rearward sides defining a flange thickness therebetween. A head portion is located at a radially outer free end of the flange body. The head portion includes an axial flange located axially rearward of the flange body and defines a rearward seal face for engagement with the blade disc forward face. A forward cantilevered head mass extends axially forward from the flange body. The flange body is angled in the forward direction away from the blade disc forward face, and an acute angle is defined between the rearward side of the flange body and an outer surface of the cylindrical member, wherein the rearward end of the cylindrical member is a planar radial surface intersecting the rearward side of the flange body at an inflexion point radially outward from the outer surface of the cylindrical member. A strong back is integrally formed with the cylindrical member and the flange body and spans between the outer surface of the cylindrical member and the forward side of the flange body. The strong back spans radially outward from the cylindrical member to an intersection point with the forward side of the flange body radially outward from the inflexion point.

The intersection point may be located at least about 40% of a radial distance between the outer surface of the cylindrical member and an inner side of the head mass. The inflexion point may be located at least about 16% of a radial distance between the outer surface of the cylindrical member and the inner side of the head mass.

An axial dimension of the head mass, from a connection with the forward side of flange body to an axially forward face of the head mass, may be about five times greater than an axial thickness of the flange body between the forward side and the rearward side.

An axial dimension of the head mass, from a connection with the forward side of flange body to an axially forward face of the head mass, may be greater than an axial dimension of the axial flange from the rearward side of the flange body to the rearward seal face. The axial dimension of the head mass may be about 42% greater than the axial dimension of the axial flange.

The axial dimension of the head mass may be greater than a maximum radial dimension of the head mass, from a radially inner side of the head mass to a radially outermost side of the head mass.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 3:
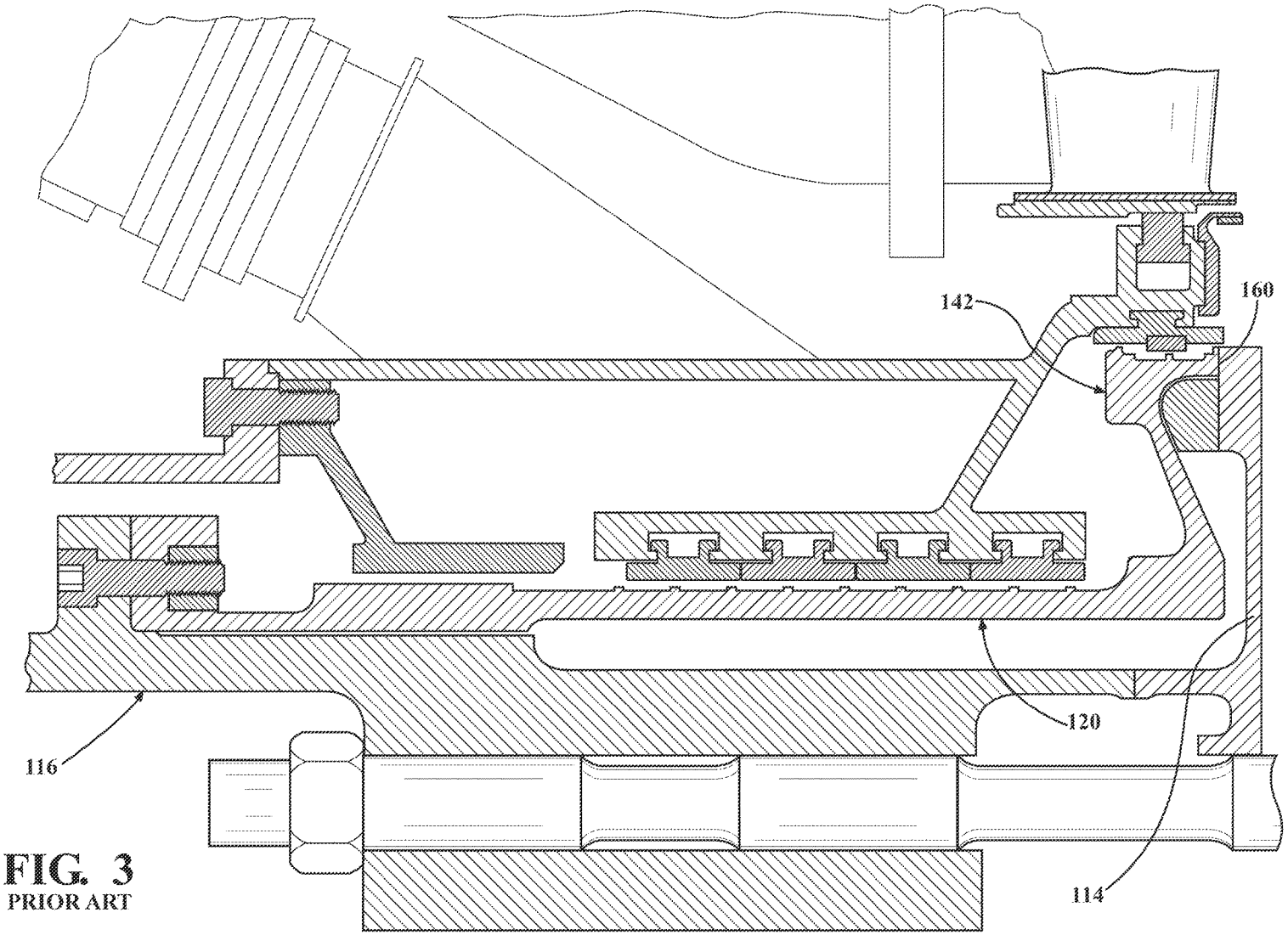
FIG. 3 PRIOR ART
FIG. 3 is a cross sectional view of an engine incorporating a known air separator.

Referring to FIG. 3, gas turbine engine is illustrated incorporating a known air separator 120. In particular, the air separator 120 is a cylindrical structure (FIG. 4) that is supported on a torque tube 116 at a forward end of a turbine section for the engine. The air separator 120 forms an interface between the torque tube 116 at a forward end of the air separator 120 and a turbine row 1 disc 114 at a rearward or aft end of the air separator 120. In the illustrated installation, the air separator 120 is bolted to the torque tube 116 and is assembled with an interference fit to the row 1 disc 114.

In accordance with an aspect of the disclosure, it has been observed that it can be beneficial to produce as great a contact force as possible at the interference contact between the air separator 120 and the turbine row 1 disc 114. In this regard, the present invention presents improvements that can affect the mass distribution and structural rigidity at the rear end of the air separator 120, in the region of a head portion 142 having a contact face 160 for the interference engagement with the row 1 disc 114.

In accordance with an aspect of the invention, an air separator design is provided that facilitates a firm axial engagement of the components at the interference fit throughout the engine operation. As seen with reference to FIG. 1, a gas turbine engine 10 is provided including rotor structure 12 having a blade disc structure, defined by a row 1 blade disc 14, and a torque tube 16 coupled to the blade disc 14. A blade disc forward face 18 is defined on an upstream side of the blade disc 14 with respect to an axial flow of hot working gas through the engine 10, and the torque tube 16 extends axially forward from the forward face 18.

It should be understood that the directional descriptions of "upstream," "forward," "downstream" and "rearward" or "aft" are provided with reference to the flow of gases through the engine, from an air inlet to an exhaust of the engine 10, in an axial direction parallel to the longitudinal axis 11 of the engine 10. Specifically, "upstream" and "forward" refer to a direction associated with or directed toward the air inlet end of the engine 10, and "downstream" and "rearward" or "aft" refer to a direction associated with or directed toward the exhaust end of the engine 10. Further, the term "radial" or "radially" refers to a direction perpendicular to and extending from the longitudinal axis 11 of the engine 10.

Figure 1:
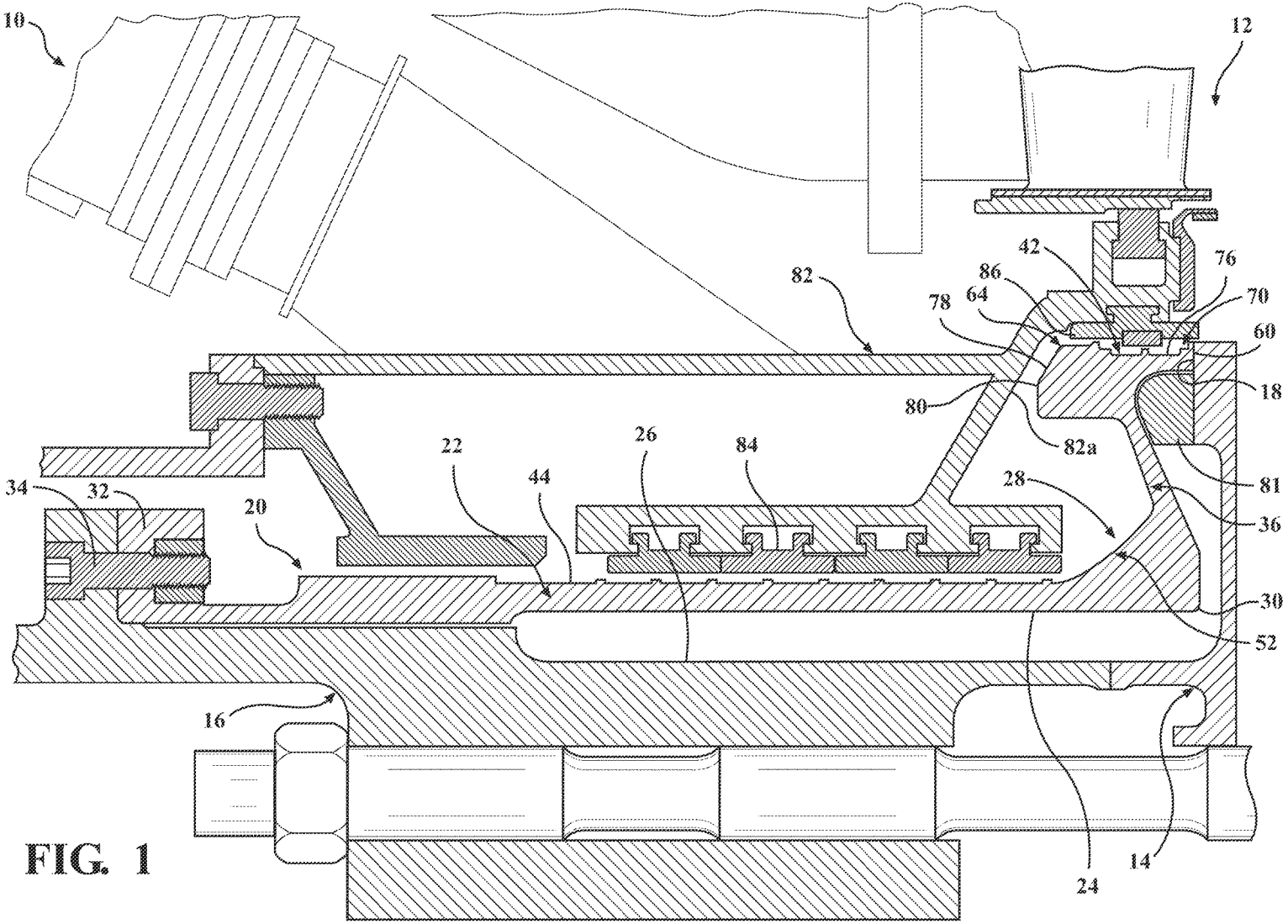
FIG. 1 is a cross sectional view of an engine incorporating aspects of the present invention.

Referring to FIG. 1, an air separator 20 is mounted to the torque tube 16 and includes a cylindrical member 22 disposed around the torque tube 16 to form a clearance between an inner surface 24 of the cylindrical member 22 and an outer surface 26 of the torque tube 16. A seal flange 28 extends radially outward at a rearward end 30 of the cylindrical member 22, and a forward end 32 of the cylindrical member 22 includes mounting structure comprising bolts 34 attaching the cylindrical member 22 to the torque tube 16.

Figure 2:
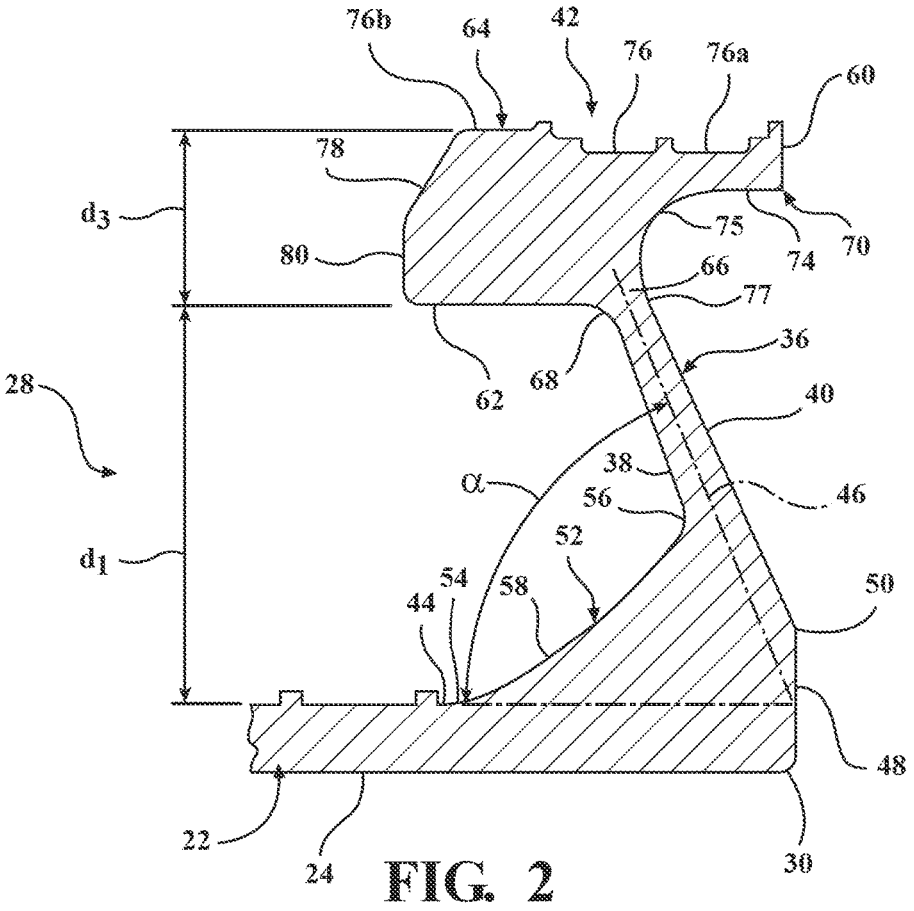
FIG. 2 is an enlarged cross sectional view of an air separator in accordance with aspects of the invention.
Figure 2A:
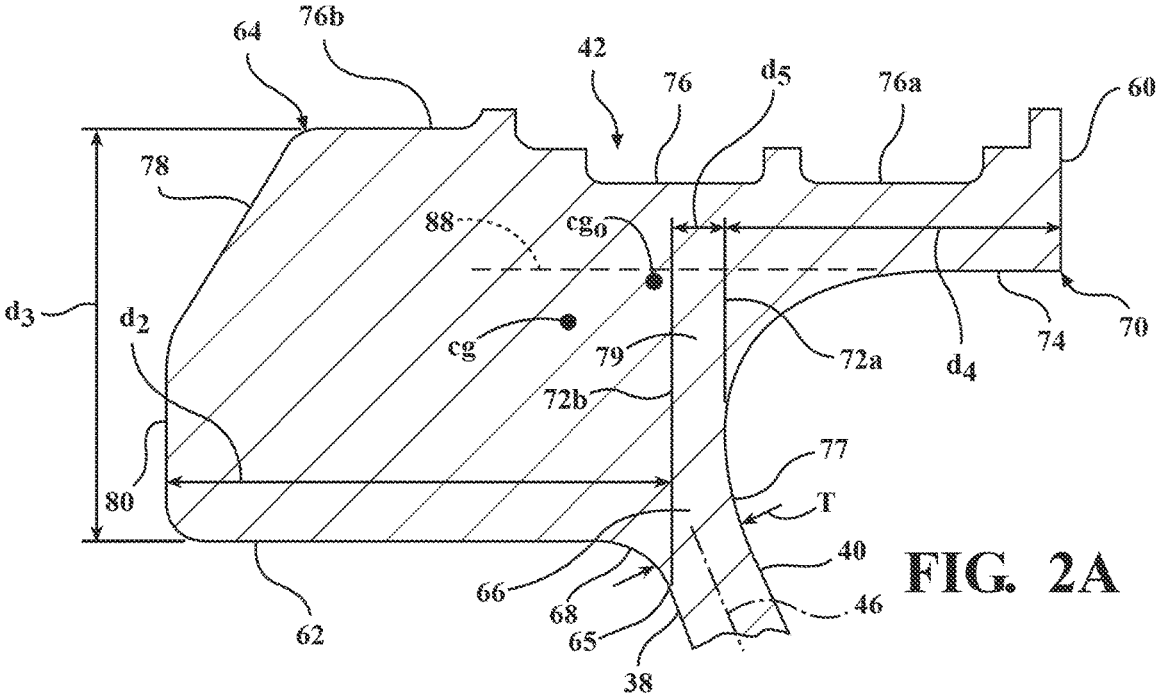
FIG. 2A is an enlarged view of a head portion for the air separator illustrated in FIG. 2.

Referring to FIGS. 2 and 2A, the seal flange 28 includes a flange body 36 having a forward side 38 extending radially outward from the cylindrical member 22, and an opposing rearward side 40. An axial flange thickness T (FIG. 2A) is defined between the forward and rearward sides 38, 40, measured in a direction perpendicular to a central flange body axis 46 extending centrally between the forward and rearward sides 38, 40 of the flange body 36. The forward and rearward sides 38, 40 may taper toward each other in the radial outward direction to a minimum thickness at a connection between the flange body 36 and a head portion 42 of the seal flange 28. The flange body 36 is angled in the forward direction away from the blade disc forward face 18, such that the forward and rearward sides 38, 40 of the flange body 36 define an acute angle with an outer surface 44 of the cylindrical member 22, as is characterized by acute angle a (FIG. 2A) depicting an angle between the central flange body axis 46 the outer surface 44 of the cylindrical member 22.

As seen in FIG. 2, the rearward end 30 of the cylindrical member 22 is a planar radial surface 48, extending radially generally perpendicular to the longitudinal axis 11 of the engine 10. The rearward side 40 of the flange body 36 forms a conical surface that intersects the surface 48 of the rearward end 30 at an inflexion point 50. The inflexion point 50 defines a circumferentially extending ridge that is located radially outward from the outer surface 44 of the cylindrical member 22.

The seal flange 28 includes a strong back 52 integrally formed with the cylindrical member 22 and the flange body 36 and spanning between the outer surface 44 of the cylindrical member 22 and the forward side 38 of the flange body 36. The strong back 52 spans radially outward from an inner point 54 at the cylindrical member 22 to an intersection point 56 with the forward side 38 of the flange body 36 radially outward from the inflexion point 50, and defines a solid mass within an area defined between the outer surface 44 and the flange body 36, i.e., within the acute angle α. An outer surface 58 of the strong back 52 is formed as a smooth or continuous surface between the points 54 and 56, and may comprise a shallow concave curved surface. The strong back 52 adds or increases the mass of the seal flange 28 at the cylindrical member 22 which, in accordance with an aspect of the invention, has been found to reduce the tendency of the rearward seal face 60 to move out of engagement with the forward face 18 of the blade disc 14. Additionally, the strong back 52 extends a substantial radial distance outward on the flange body 36, operating as a support against forward movement of the flange body 36. The substantial radial distance defining the location of the intersection point 56 can be a radial distance located radially outward from the radial location of the inflexion point 50. More particularly, the intersection point 56 is located radially outward from the outer surface 44 at least about 40% of a radial distance $d_1$ between the outer surface 44 of the cylindrical member 22 and a radially inner side 62 of a head mass 64 on the head portion 42 of the seal flange 28, as is described more fully below. Further, the inflexion point 50 is located radially outward at least about 16% of the radial distance $d_1$.

Referring to FIG. 2, the head portion 42 is located at the radially outer end 66, or free end, of the flange body 36. It may be noted that the outer end 66 is generally defined at a radial location where a connecting fillet 68 is formed as a curved portion extending between the flange body forward side 38 and the head mass inner side 62, and extending axially across to a location where a connecting fillet 75 is formed as a curved portion extending between the flange body rearward side 40 and an inner side 74 of an axial flange 70 of the head portion 42 that is located axially rearward of the flange body 36.

Referring to FIG. 2A, the axial flange 70 defines the rearward seal face 60 that engages the blade disc forward face 18 (FIG. 1). The axial flange 70 is defined as a section of the head portion 42 that extends axially rearward from a rearward interface location 72*a*, which is an axial location defined by a line extending radially perpendicular to the longitudinal axis 11 from a radially inner end 77 of the fillet 75 at the rearward side 40 of the flange body 36. It may be noted that the fillet 75 is a contoured surface configured to fit close to and spaced about a similarly shaped lip 81 extending axially forward from the disc forward face 18.

An intermediate head section 79 is defined between the rearward interface location 72*a* and a forward interface location 72*b* aligned with a radially inner end 65 of the fillet 68 at the forward side 38 of the flange body 36. That is, the forward interface location 72*b* is defined as an axial location intersected by a line extending radially perpendicular to the longitudinal axis 11 from the radially inner end 65 of the fillet 68, and defines a rearward end of the head mass 64 where it interfaces with the intermediate head section 79.

The rearward seal face 60 extends radially outward from the axial flange inner side 74, perpendicular to the longitudinal axis 11, and defines an annular surface for engagement with the blade disc forward face 18. An outer side 76 of the head portion 42 defines an outermost side 76*a* of the axial flange 70 and an outermost side 76*b* of the head mass 64. The head portion outer side 76 extends axially from the rearward seal face 60 to an angled forward side portion 78. The angled forward side portion 78 angles in a radially inward direction from the outer side 76 to an axially forward face 80 of the head mass 64, and the axially forward face 80 defines an axially forward surface of the head portion 64 extending perpendicular to the longitudinal axis 11. As may be seen with reference to FIG. 1, the angled forward side portion 78 defines a contoured section of the head mass 64 that provides clearance between the head mass 64 and an angled member 82*a* of a seal support structure 82 supporting seals 84 and 86 that cooperate with the cylindrical member outer surface 44 and the head portion outer side 76, respectively.

In accordance with an aspect of the invention, the head mass 64 provides a substantial increase in mass to the head portion 42 as compared to the head portion 142 of the prior seal flange, such as is described above with reference to FIGS. 3-5. The increased mass of the head portion 42 is characterized by the head mass 64 being formed as a forward cantilevered structure of the head portion 42. The head mass 64 has an axial dimension $d_2$, from the rearward side of the head mass 64, as defined by the forward axial location 72*b*, to the axially forward face 80 of the head mass 64, as may be seen in FIG. 2A. The dimension $d_2$ is greater than a maximum radial dimension $d_3$ of the head mass 64, from the radially inner side 62 of the head mass 64 to the radially outermost side 76*b* of the head mass 64.

Generally, the axial dimension $d_2$ of the head mass 64 is greater than an axial dimension $d_4$ of the axial flange 70 from the forward side of the flange body 70, as defined by the interface location 72*a*, to the rearward seal face 60. In an optimized configuration, the axial dimension $d_2$ of the head mass 64 is about 42% greater than an axial dimension $d_4$ of the axial flange 70. The intermediate section 79 of the head portion 42 has an axial dimension $d_5$ between the rearward and forward interface locations 72*a*, 72*b* that is about 25% of the axial dimension $d_4$ of the axial flange 70, and the overall axial dimension of the head portion 42 is equal to the sum of $d_2$, $d_4$ and $d_5$.

Figure 4:
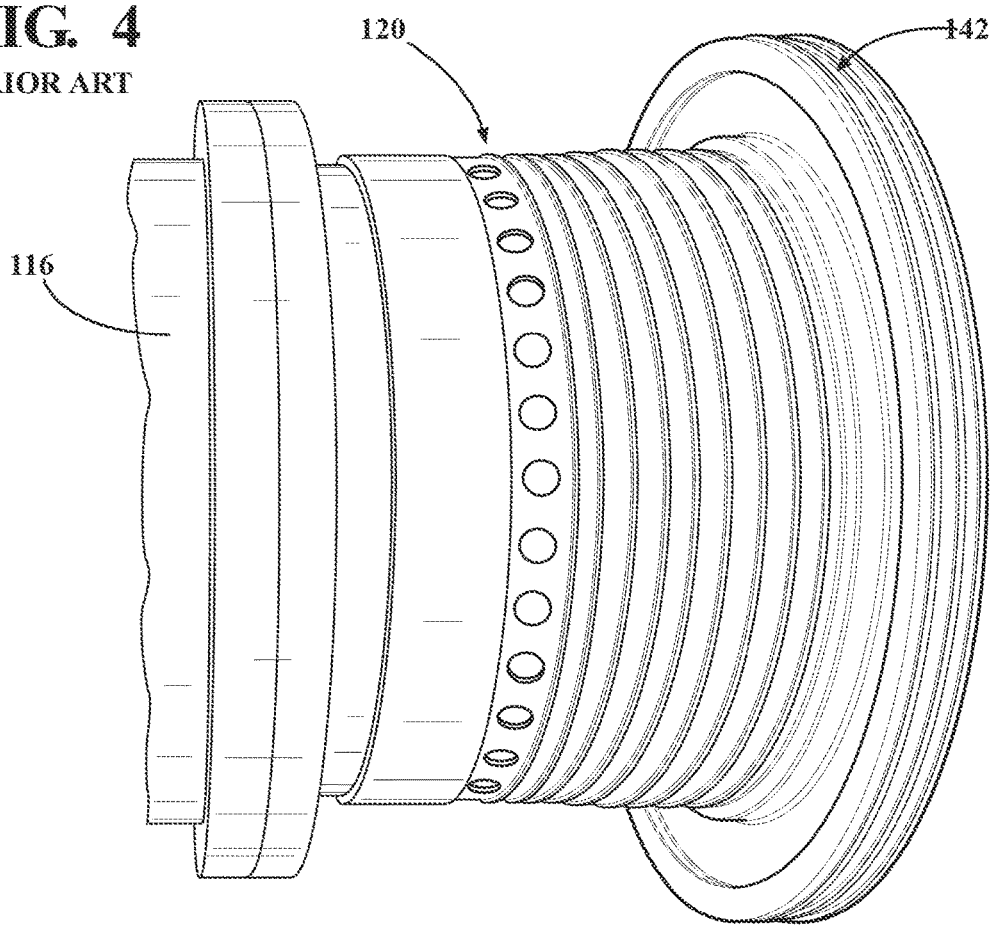
FIG. 4 PRIOR ART
FIG. 4 is a perspective view of the air separator shown in FIG. 3.

The substantial size of the head mass 64 relative the size of the corresponding structure on the head portion 142 of the prior air separator 120, as described with reference to FIGS. 3-5, results in a displacement of the center of gravity cg of the head portion 42 relative to the center of gravity $cg_o$ of the prior air separator 120, as is illustrated in FIGS. 1 and 2A. Specifically, the center of gravity cg of the present head portion 42 is shifted axially in the forward direction away from the seal face 60 about 29% relative to the position of the center of gravity $cg_o$ of the head portion of the prior air separator 120, and is located spaced forwardly from the flange body 36. Additionally, the center of gravity cg is shifted radially in the inward direction toward the longitudinal axis 11 about 49% relative to the position of the center of gravity $cg_o$ of the prior air separator 120, as measured with reference from a line 88 radially aligned with the inner side 74 of the axial flange 70.

The mass and center of gravity cg location of the head mass 64 increases a moment of inertia for causing the head mass 64 to move outward about the outer end 66 of the flange body 36 with a corresponding biasing of the flange portion 70 to move radially inward and axially rearward in order to maintain a predetermined contact between the surface of the flange portion 70 and the disc forward face 18. In this regard, it should be noted that the axial dimension $d_2$ of the head mass 64 is substantially greater than the thickness T of the flange body 36, and is preferably about five times greater than the thickness T of the flange body 36. Hence, the material thickness of the flange body 36 at the connection with the head portion 42 is sufficiently thin relative to the head mass 64 to permit a controlled biasing or pivoting of the head portion 70 about the flange body outer end 66 during rotation of the air separator 28 with the rotor structure 12, to ensure a firm axial engagement of the seal face 60 relative to the disc forward face 18 during engine operation.

It should be understood that as a result of providing the head mass 64 and the additional mass and stiffening effect of the strong back 52, an improved biasing force at the interference fit between the rearward seal face 60 and the disc forward face 18 is provided. The improved biasing force results in a substantially evenly distributed contact force in the radial direction across the seal face 60 and an increased reaction load at the interface between the rearward seal face 60 and the disc forward face 18.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine comprising:

a rotor structure including a blade disc structure and a torque tube coupled to the blade disc structure;

a blade disc forward face defined on an upstream side of the blade disc structure with respect to an axial flow of hot working gas through the engine, and the torque tube extending axially forward from the forward face;

an air separator that includes a cylindrical member disposed around the torque tube to form a clearance between an inner surface of the cylindrical member and an outer surface of the torque tube, a seal flange extending radially outward at a rearward end of the cylindrical member and a forward end of the cylindrical member including mounting structure attaching the cylindrical member to the torque tube;

the seal flange including:

a flange body having a forward side extending radially outward from the cylindrical member, and an opposing rearward side, the forward and rearward sides defining a flange thickness therebetween;

a head portion at a radially outer free end of the flange body, the head portion including:

an axial flange located axially rearward of the flange body and defining a rearward seal face for engagement with the blade disc forward face, and a forward cantilevered head mass extending axially forward from the flange body; wherein the head mass comprises an axial dimension and a maximum radial dimension the axial dimension of the head mass, from a connection with the forward side of flange body to an axially forward face of the head mass, is greater than the maximum radial dimension of the head mass, from a radially inner side of the head mass to a radially outermost side of the head mass.

2. The gas turbine engine of claim 1, wherein the axial dimension of the head mass is greater than an axial dimension of the axial flange from the rearward side of the flange body to the rearward seal face.

3. The gas turbine engine of claim 2, wherein the axial dimension of the head mass is 42% greater than the axial dimension of the axial flange.

4. The gas turbine engine of claim 2, the axial dimension of the head mass is about five times greater than an axial thickness of the flange body between the forward side and the rearward side.

5. The gas turbine engine of claim 1, wherein the flange body is angled in the forward direction away from the blade disc forward face, defining an acute angle between the forward side of the flange body and an outer surface of the cylindrical member.

6. The gas turbine engine of claim 5, wherein an acute angle is defined between the rearward side of the flange body and the outer surface of the cylindrical member, wherein the rearward end of the cylindrical member is a planar radial surface intersecting the rearward side of the flange body at an inflexion point radially outward from the outer surface of the cylindrical member.

7. The gas turbine engine of claim 6, including a strong back spanning between the outer surface of the cylindrical member and the forward side of the flange body, the strong back spanning radially outward from the cylindrical member to an intersection point with the forward side of the flange body radially outward from the inflexion point.

8. The gas turbine engine of claim 7, wherein the intersection point is located at least 40% of a radial distance between the outer surface of the cylindrical member and the inner side of the head mass.

9. The gas turbine engine of claim 7, wherein the inflexion point is located at least 16% of a radial distance between the outer surface of the cylindrical member and the inner side of the head mass.

10. A gas turbine engine comprising:

a rotor structure including a blade disc structure and a torque tube coupled to the blade disc structure;

a blade disc forward face defined on an upstream side of the blade disc structure with respect to an axial flow of hot working gas through the engine, and the torque tube extending axially forward from the forward face;

an air separator that includes a cylindrical member disposed around the torque tube to form a clearance between an inner surface of the cylindrical member and an outer surface of the torque tube, a seal flange extending radially outward at a rearward end of the cylindrical member and a forward end of the cylindrical member including mounting structure attaching the cylindrical member to the torque tube;

the seal flange including:

a flange body having a forward side extending radially outward from the cylindrical member, and an opposing rearward side, the forward and rearward sides defining a flange thickness therebetween;

a head portion at a radially outer free end of the flange body, the head portion including:

an axial flange located axially rearward of the flange body and defining a rearward seal face for engagement with the blade disc forward face, and a forward cantilevered head mass extending axially forward from the flange body;

wherein the flange body is angled in the forward direction away from the blade disc forward face, and an acute angle is defined between the rearward side of the flange body and an outer surface of the cylindrical member, wherein the rearward end of the cylindrical member is a planar radial surface intersecting the rearward side of the flange body at an inflexion point radially outward from the outer surface of the cylindrical member; and including a strong back integrally formed with the cylindrical member and the flange body and spanning between the outer surface of the cylindrical member and the forward side of the flange body, the strong back spanning radially outward from the cylindrical member to an intersection point with the forward side of the flange body radially outward from the inflexion point, wherein the intersection point is located at least 40% of a radial distance between the outer surface of the cylindrical member and a radially inner side of the head mass.

11. The gas turbine engine of claim 10, wherein the inflexion point is located at least 16% of a radial distance between the outer surface of the cylindrical member and the inner side of the head mass.

12. The gas turbine engine of claim 10, wherein an axial dimension of the head mass, from a connection with the forward side of flange body to an axially forward face of the head mass, is about five times greater than an axial thickness of the flange body between the forward side and the rearward side.

13. The gas turbine engine of claim 10, wherein an axial dimension of the head mass, from a connection with the forward side of flange body to an axially forward face of the head mass, is greater than an axial dimension of the axial flange from the rearward side of the flange body to the rearward seal face.

14. The gas turbine engine of claim 13, wherein the axial dimension of the head mass is 42% greater than the axial dimension of the axial flange.

15. The gas turbine engine of claim 13, wherein the axial dimension of the head mass is greater than a maximum radial dimension of the head mass, from a radially inner side of the head mass to a radially outermost side of the head mass.

* * * * *